US011951413B2

(12) United States Patent
Hamilton

(10) Patent No.: US 11,951,413 B2
(45) Date of Patent: Apr. 9, 2024

(54) MODULAR WEARABLE MOBILE AND TOY ACCESSORY SYSTEM

(71) Applicant: Westray Toys, Ltd., Harrogate (GB)

(72) Inventor: Mark Hamilton, Harrogate (GB)

(73) Assignee: WESTRAY TOYS, LTD., Harrogate (GB)

( * ) Notice: Subject to any disclaimer, the term of this patent is extended or adjusted under 35 U.S.C. 154(b) by 296 days.

(21) Appl. No.: 17/536,855

(22) Filed: Nov. 29, 2021

(65) Prior Publication Data

US 2022/0355217 A1 Nov. 10, 2022

Related U.S. Application Data

(60) Provisional application No. 63/184,255, filed on May 5, 2021.

(51) Int. Cl.

| | |
|---|---|
| ***A63H 33/00*** | (2006.01) |
| ***A41D 20/00*** | (2006.01) |
| ***A42B 1/004*** | (2021.01) |
| ***A44C 25/00*** | (2006.01) |

(52) U.S. Cl.

CPC ..... *A63H 33/006* (2013.01); *A41D 20/00* (2013.01); *A42B 1/004* (2013.01); *A44C 25/00* (2013.01)

(58) Field of Classification Search

CPC .. A63H 33/006; A63H 33/067; A63H 33/106; H01B 9/00; H01B 9/04

See application file for complete search history.

(56) References Cited

U.S. PATENT DOCUMENTS

| | | | | |
|---|---|---|---|---|
| 4,026,621 | A * | 5/1977 | Korba | F02P 17/06 439/502 |
| 5,027,992 | A * | 7/1991 | Murray, III | G09F 21/02 D2/869 |
| 5,395,278 | A * | 3/1995 | Dickhut | A63H 33/00 446/490 |
| 5,916,006 | A * | 6/1999 | Ganson | A63H 33/00 446/107 |
| 6,047,709 | A | 4/2000 | Tu | |
| 6,532,601 | B1 * | 3/2003 | Berman | A42B 3/0406 2/209.13 |
| 6,626,184 | B1 | 9/2003 | Cheng | |
| 7,025,654 | B2 * | 4/2006 | Oren | A63H 33/006 446/228 |
| 7,762,865 | B2 * | 7/2010 | Gelfond | A63H 33/006 446/318 |

(Continued)

FOREIGN PATENT DOCUMENTS

| | | | |
|---|---|---|---|
| GB | 2318522 | A | 4/1998 |
| WO | 2016149731 | A1 | 9/2016 |

*Primary Examiner* — John A Ricci

(74) *Attorney, Agent, or Firm* — Geoffrey Lottenberg; Berger Singerman LLP

(57) ABSTRACT

A modular mobile and accessory system, includes a flexible rod made of an elongated flexible member wrapped with a relatively softer material. The flexible rod has end caps on either or both ends, which end caps releasably engage corresponding accessory caps on an accessory, such as a toy or other item. The system includes a wearable headband for handsfree use of a toy or mobile to entertain a child. Other uses are contemplated, such as attaching the rod to a claw element which is secured to a crib or other fixed surface or element.

8 Claims, 9 Drawing Sheets

(56) References Cited

U.S. PATENT DOCUMENTS

| | | | | |
|---|---|---|---|---|
| 8,944,514 | B2 * | 2/2015 | Tadin | A47D 1/0081<br>297/219.12 |
| 2002/0118535 | A1 * | 8/2002 | Nostrant | A63H 3/006<br>362/124 |
| 2005/0045366 | A1 * | 3/2005 | Wolff | H01B 9/024<br>174/113 R |

* cited by examiner

MODULAR WEARABLE MOBILE AND TOY ACCESSORY SYSTEM

CROSS REFERENCE TO RELATED APPLICATIONS

This application claims priority to U.S. Provisional App. No. 63/184,255 filed on May 5, 2021.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE INVENTION

In the following description, for the purposes of explanation, numerous specific details are set forth in order to provide a thorough understanding of the invention. It will be apparent, however, to one skilled in the art that the invention may be practiced without some of these specific details. Throughout this description, the embodiments and examples shown should be considered as exemplars, rather than as limitations on the invention. That is, the following description provides examples, and the accompanying drawings show various examples for the purposes of illustration. However, these examples should not be construed in a limiting sense as they are merely intended to provide examples of the invention rather than to provide an exhaustive list of all possible implementations of the invention.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

Figure 1:
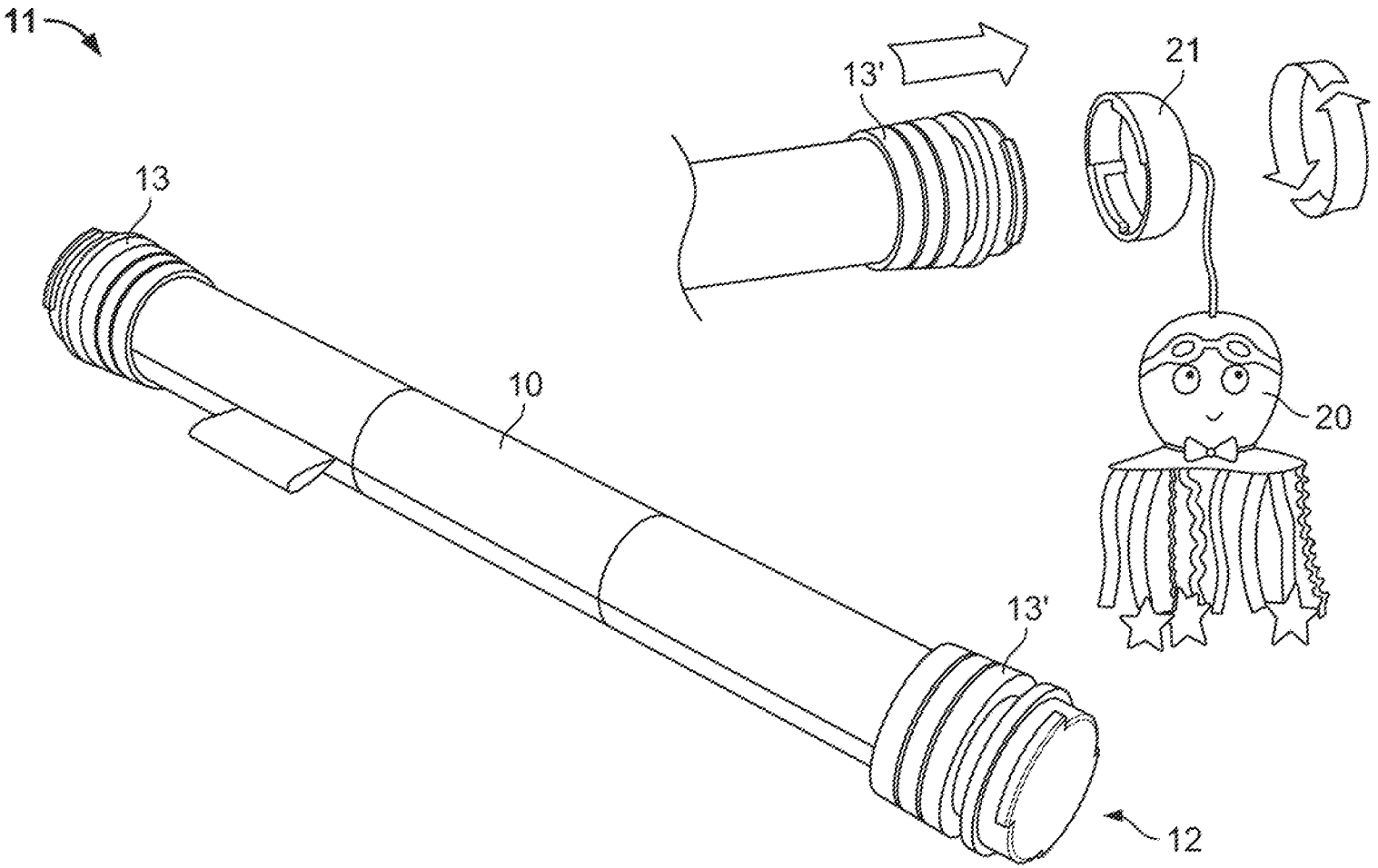
FIG. 1 shows a perspective view of an embodiment of the flexible rod component of the system and related accessories.

With reference to FIG. 1, shown are several components of the modular, wearable mobile and toy accessory system of the present invention. Shown is a flexible rod 10 with a proximal end 11 and a distal end 12. The distal end 12 is configured to releasably engage an accessory 20, such as a dangling toy or other item as further described herein. In some embodiments, the proximal and distal end 11 and 12 of the rod 10 are fitted with respective end caps 13 and 13'. The end caps 13 and 13' provide a means to releasably fasten the end caps to various components. Fastening may be accomplished by a snap fit, interference fit, a tongue-and-groove fit, magnetic connections, and the like. In some embodiments, as shown in FIG. 1, a rotating tongue-and-groove fitting is used, with end caps 13 and 13' comprising the male fitting and the accessory 20 having an accessory cap 21 comprising a corresponding female fitting.

Figure 2:
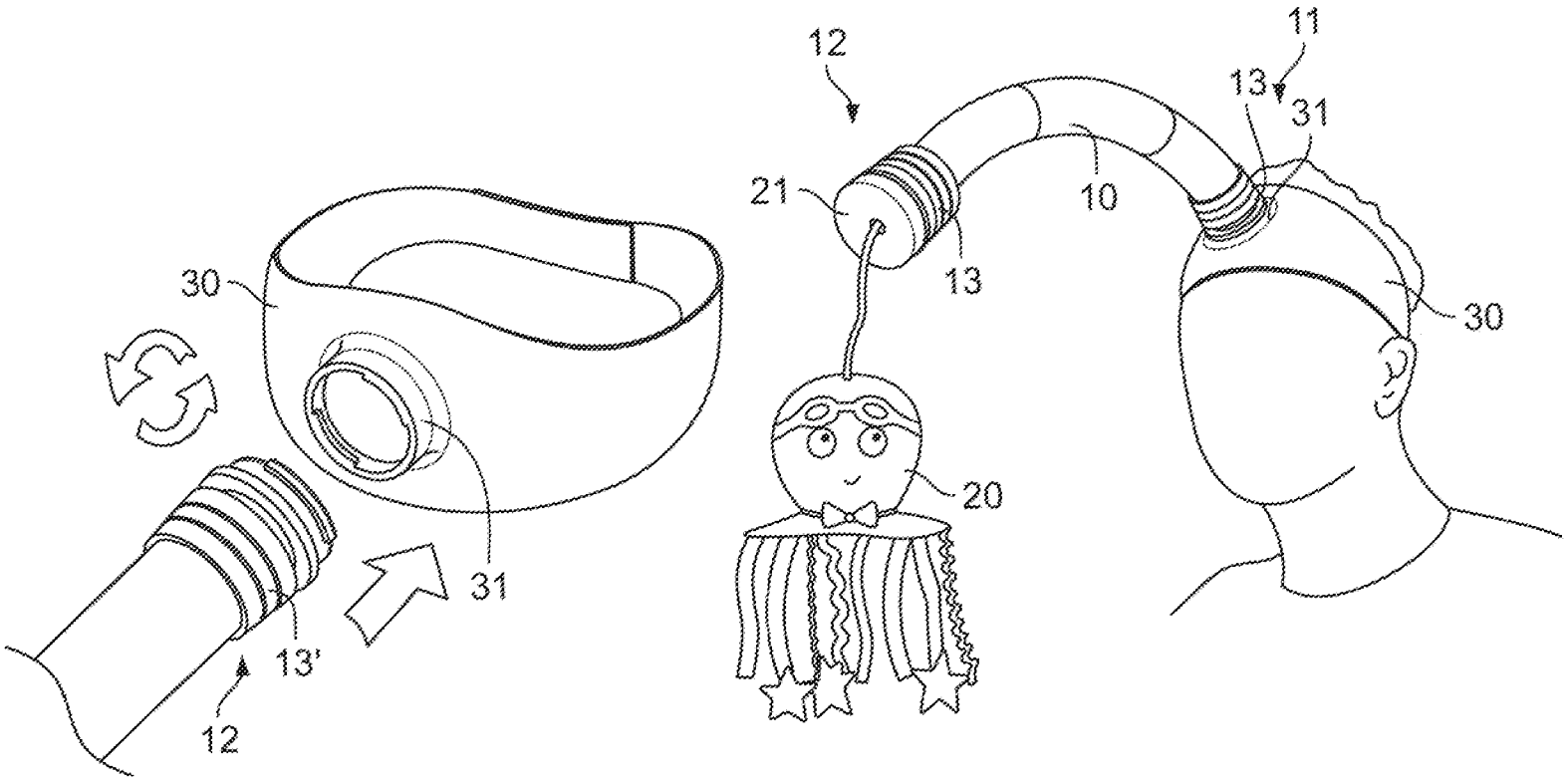
FIG. 2 shows the system in use with a headband for handsfree use.

With reference to FIG. 2, shown is a headband 30 into which the proximal end 11 of the rod 10 is received. Here, the headband 30 includes an accessory cap 31 comprising a female fitting which corresponds to the male fitting of the end cap 13' of the rod 10 (in this case, the same rotating tongue-and-groove fitting show in FIG. 1). When assembled, the accessory 20 is attached at the distal end 12 of the rod 10 with the proximal end 11 of the rod 10 secured to the headband 30. In one non-limiting example, this allows the wearer to dangle the accessory 20, such as a toy, over a child in order to entertain the child in a "hands-free" fashion. In some embodiments, the accessory cap 31 includes a trim piece (where 31 points) which at least partially covers the connection between end cap (13 or 13', as the case may be), and the accessory cap 31.

Figure 3:
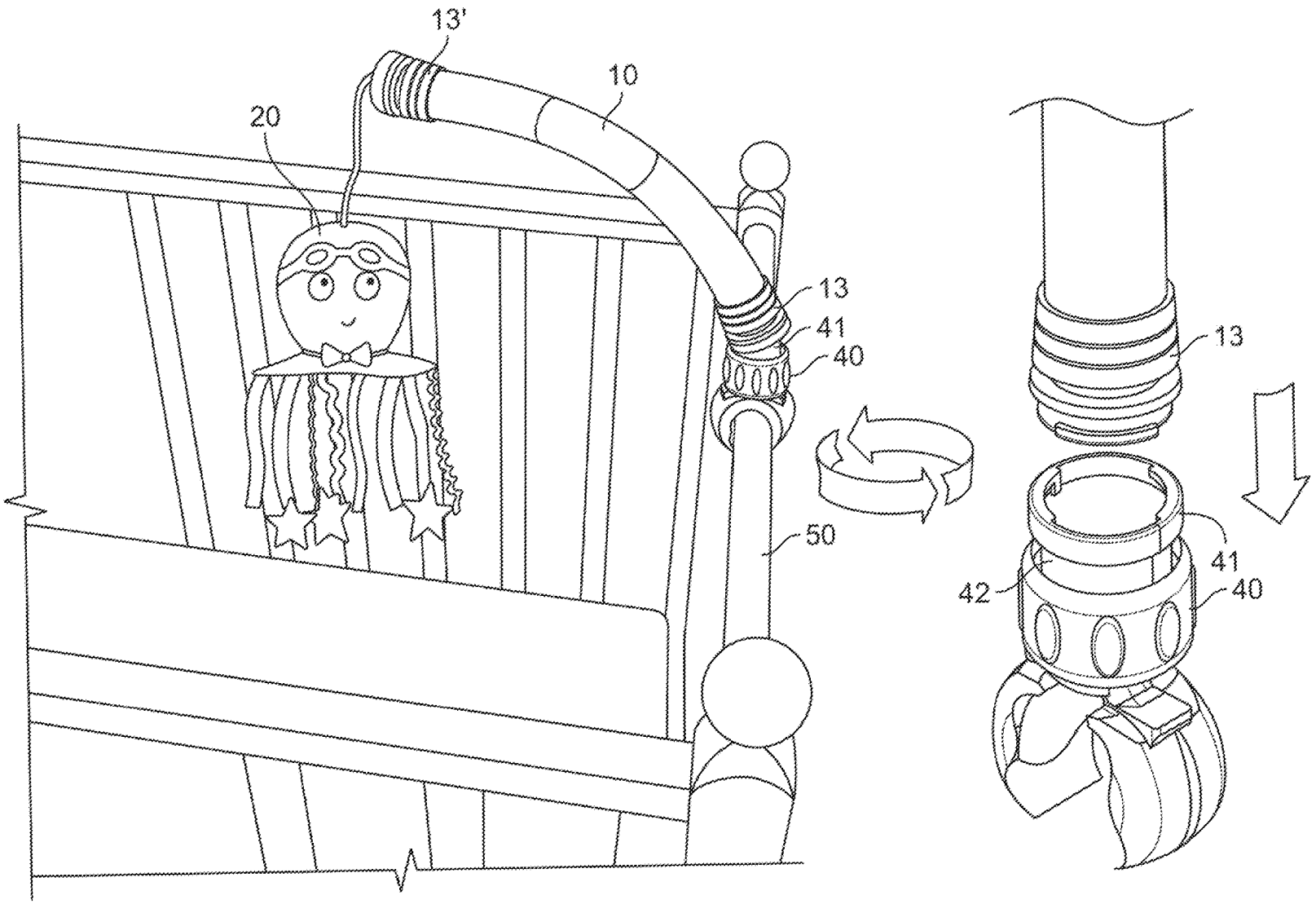
FIG. 3 shows the system in use with a claw accessory to attach the rod to a crib.

FIG. 3 shows another embodiment of the system incorporating an adjustable claw 40 which provides a means to attach the proximal end 11 of the rod to a fixed location, such as the rail 50 of a crib. It is appreciated that the claw 40 can be used to attached the system to other devices such as a stroller, bassinet, or "pack-and-play" portable crib. Here, the claw 40 includes an accessory cap 41 comprising a female fitting which corresponds to the male fitting of the end cap 13' of the rod 10 (in this case, the same rotating tongue-and-groove fitting shown in FIG. 1). To ease assembly, in some embodiments, the accessory cap 41 is rotatably mounted to the claw 40 so that it can be turned and locked onto the end cap 13' of the rod 10. When assembled, the accessory 20 is attached at the distal end 12 of the rod 10 with the proximal end 11 of the rod 10 secured to the claw 40. In one non-limiting example, this allows the user to dangle the accessory 20, such as a toy, over the crib. In some embodiments, the claw 40 includes a relatively rigid mount 42, but in an alternative embodiment, the mount 42 may comprise a pivot mount 42 such as a ball-and-joint or other articulating element to facilitate adjustment and repositioning of the rod 10.

Figure 4:
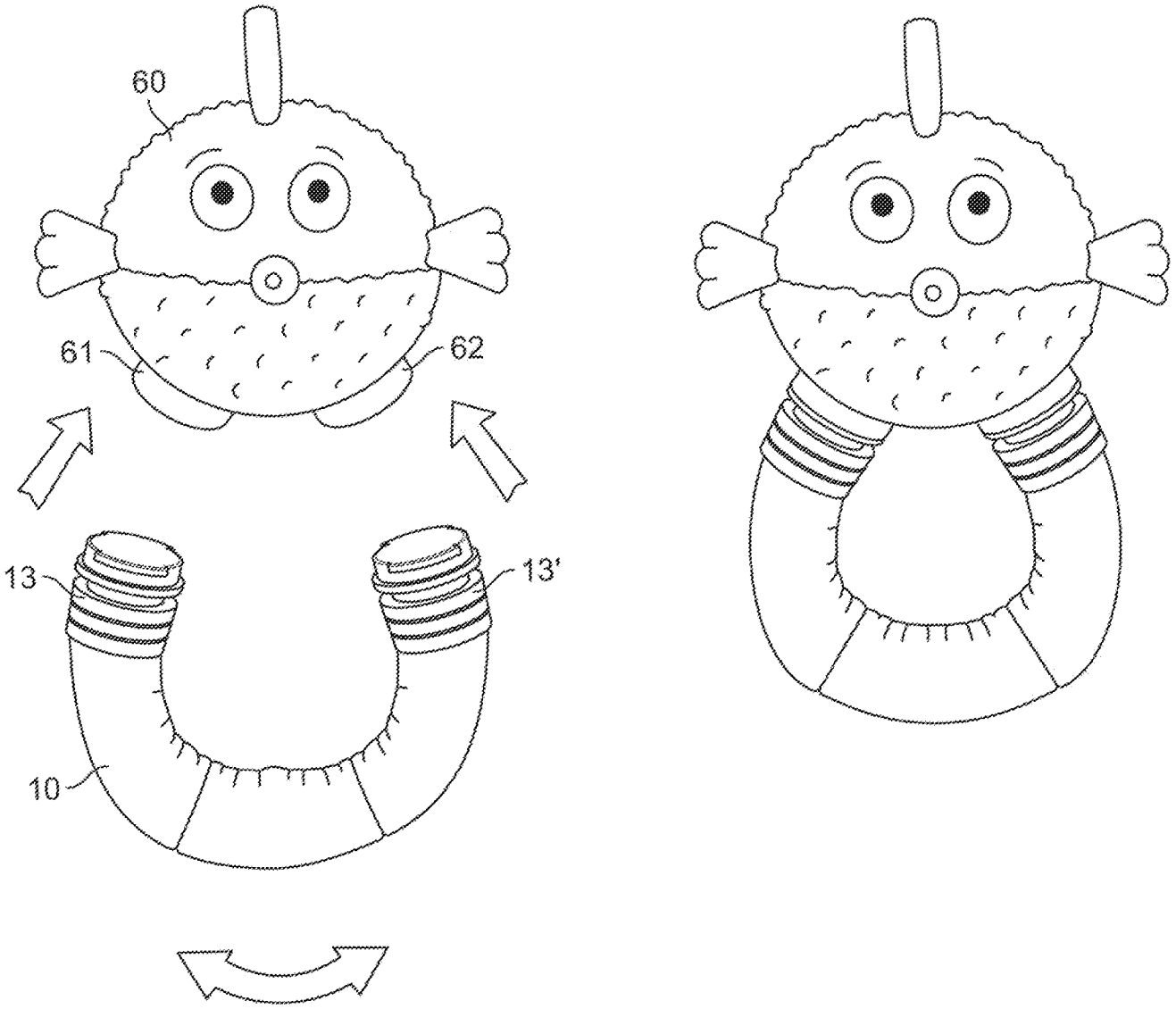
FIG. 4 shows the rod attached at both ends to a single accessory to provide a graspable rattle.

FIG. 4 shows another use for the rod 10. Here, both the proximal and distal ends 11 and 12 of the rod 10 are attached an accessory 60, such as a rattle toy, in order to provide a graspable toy for a child. In this way, the rod 10 is bent into a horse-shoe shape and the respective end caps 13 and 13' are received into respective fittings 61 and 62 of the accessory 60. In some embodiments, the same tongue-and-groove fitting described above may be employed. In this configuration, the rod 10 forms a handle or grasping element for the accessory 60.

Figure 5:
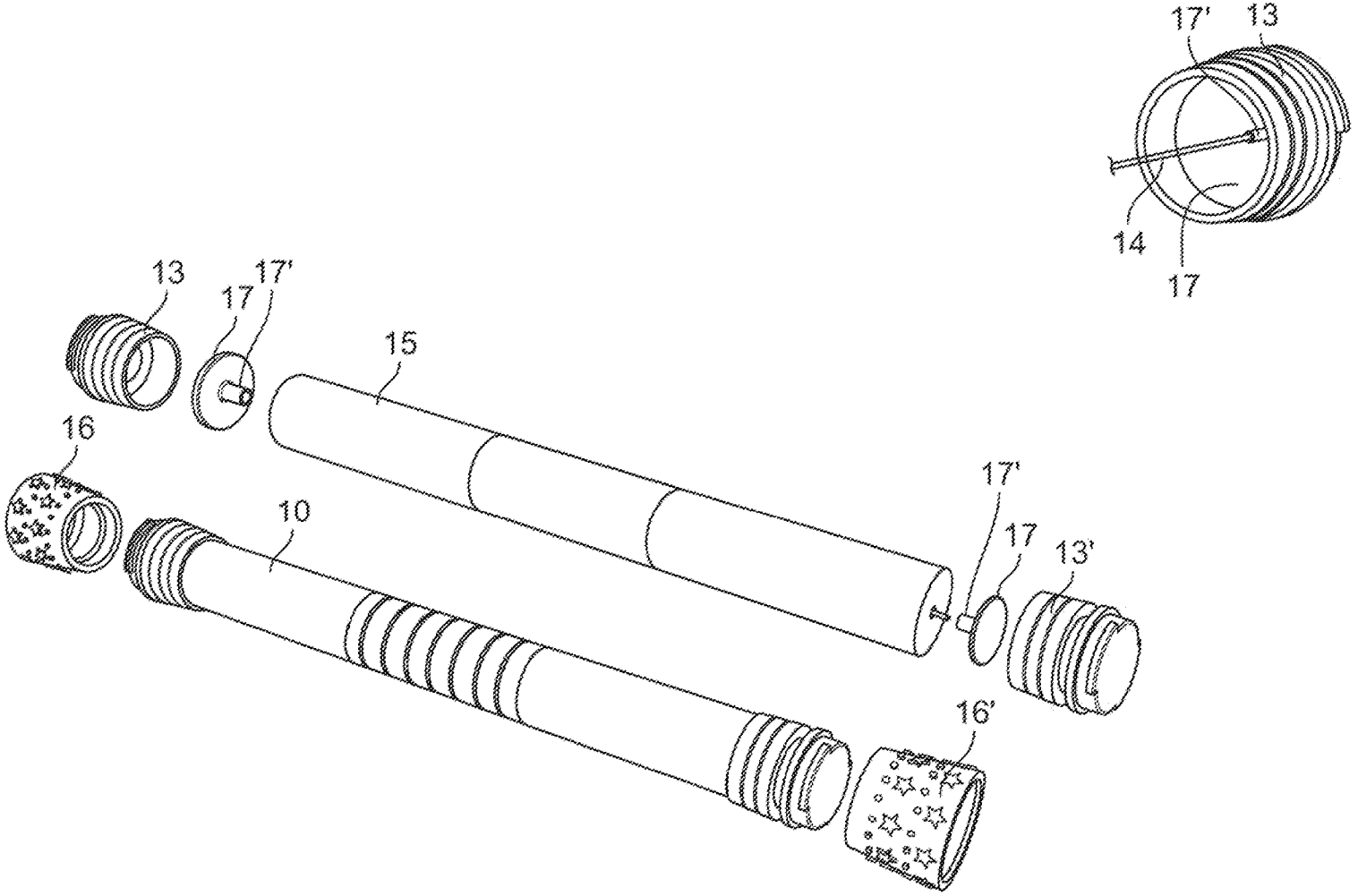
FIG. 5 shows an embodiment of the construction of the rod, with an elongated flexible member and softer outer material along with sleeves that cover the end caps.
Figure 6:
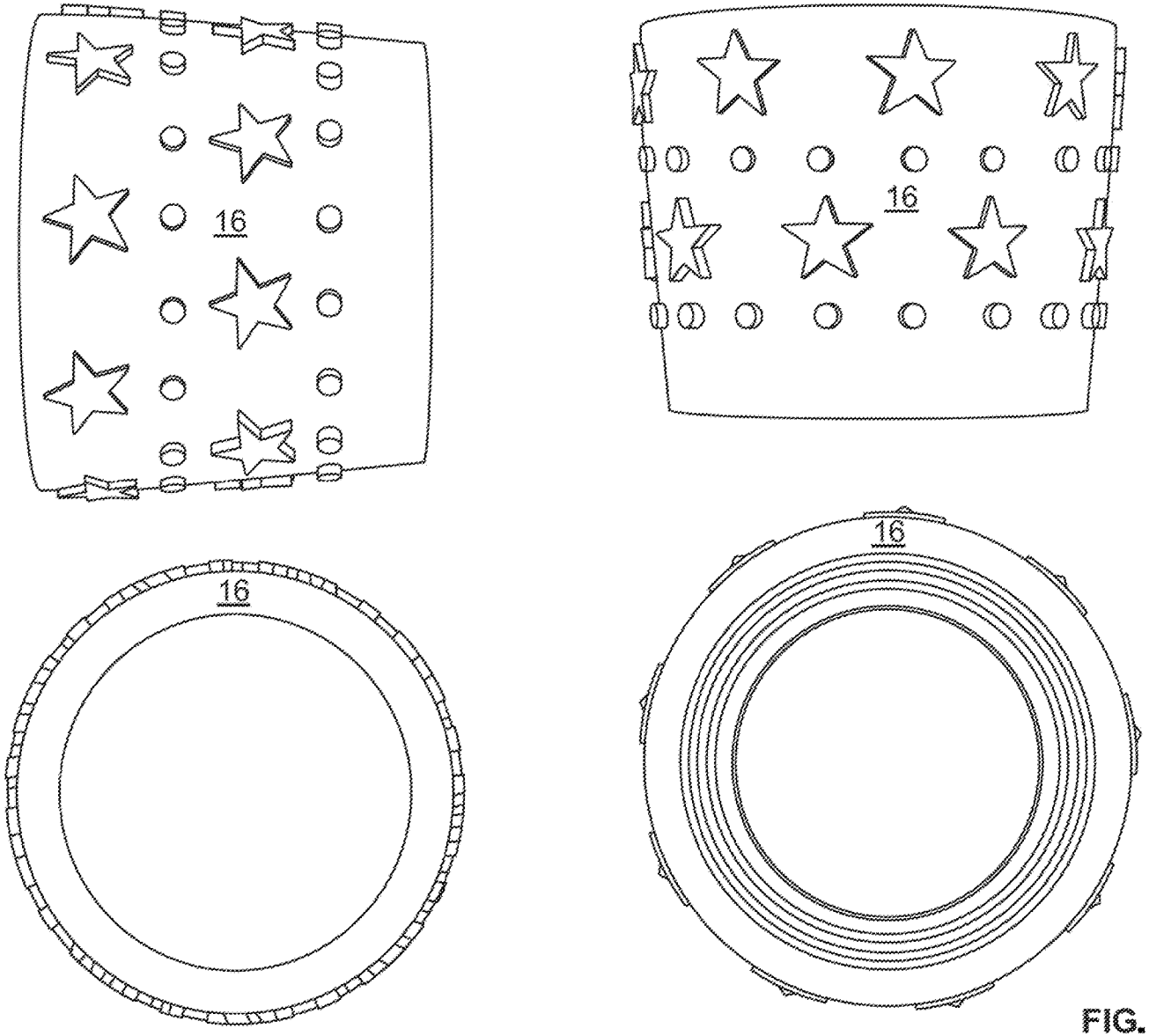
FIG. 6 shows the sleeve.

With reference to FIG. 5, shown is an exemplary embodiment of the construction of the rod 10. In some embodiments, the rod comprises a elongated flexible member 14 surrounded at least partially or sectioned by a soft padded, crinkly material 15. The elongated flexible member 14 is configured to be deformable and resilient, but also flexible such that the rod 10 can be oriented and flexed into a number of desired positions. As shown, the end caps 13 and 13' which include fitting geometry are placed over the ends of the rod 10 and cover the unfinished elongated flexible member/material construction. In some embodiments, the end caps 13 and 13' are relatively rigid for durability and to facilitate fitting with other components. Accordingly, respective sleeves 16 and 16' may optionally be provided over either or both end caps 13 and 13' which sleeves are comprises of a softer material, such as silicone or rubber and which may be embossed or debossed with designs to improve aesthetics. Close up views of an example of such a sleeve is shown in FIG. 6. Also shown is a wire cap 17 which includes an insertion tang 17', which wire cap 17 is seated inside the end caps 13 and 13'. The insertion tang 17' receives and retains the elongated flexible member 14.

Figure 7:
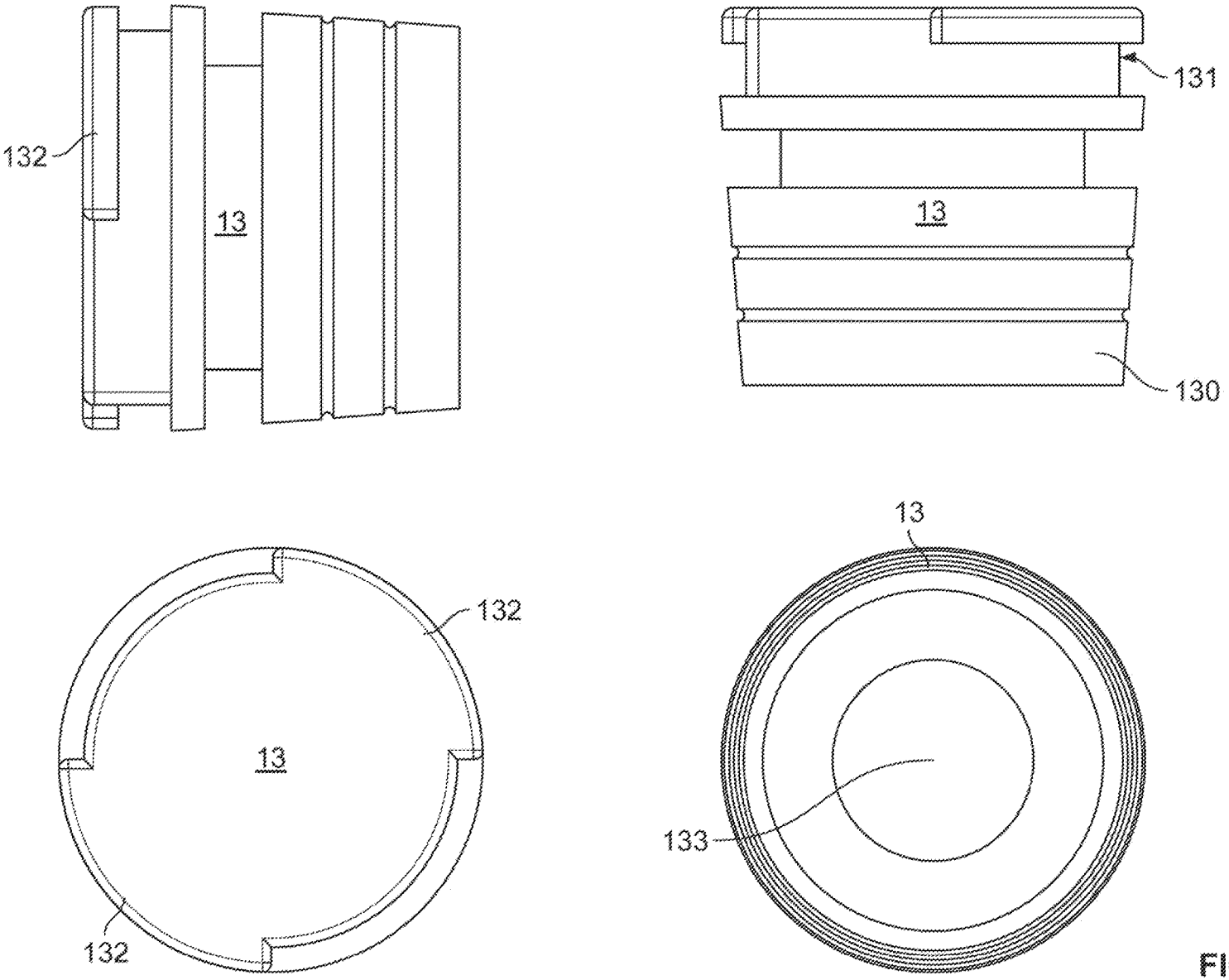
FIG. 7 shows the end cap configured as a male fitting.

FIG. 7 shows close-up plan views of an embodiment of end cap 13 (or 13"), configured as a male tongue-and-groove fitting. As shown, the end cap has a tapered body section 130 and includes a narrowed male fitting section 131 which extends away from the tapered body 130. One or more tongue sections 132 extending radially outward from the fitting section 131. The tongue sections 132 fit into corresponding grooves on the accessory cap 80 shown in FIG. 8. Also shown at the interior of the end cap 13 is an opening 133 against which the wire cap 17 (shown in FIG. 5) seats to retain the elongated flexible member 14 of the rod 10.

Figure 8:
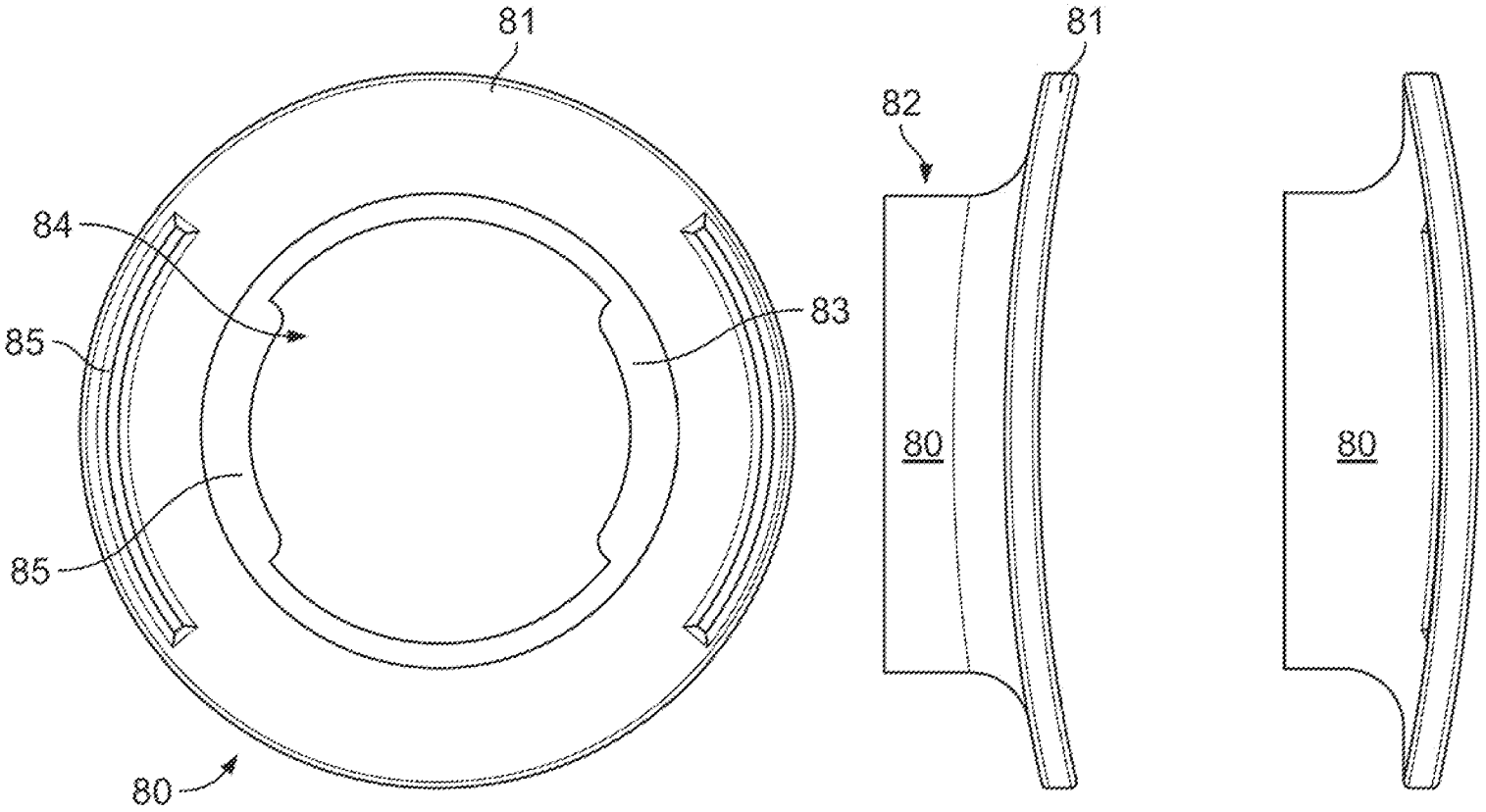
FIG. 8 shows the accessory cap configured as a female fitting.

With reference to FIG. 8 shown is one embodiment of accessory cap 80 configured as a female tongue-and-groove fitting. This version of accessory cap 80 is intended for applications where the cap is sewn in or attached to surfaces or other elements, such as headband 30 the like. Other uses are apparent, however. Here, the accessory cap 80 includes a base section 81 with a narrowed female fitting section 82 extending outwardly therefrom. In some embodiments, the perimeter of the edge of the female fitting section 82 includes inwardly extending notches 83, which delimit grooves 84. Accordingly, the tongue sections 132 of end cap 13 (as shown in FIG. 7) are received into the grooves 84 such that the male end cap 13 is seated inside the female accessory cap 80. When the fitting is rotated, the tongue sections 132 are disposed at least partially behind the notches 83, thus securing the fitting of the two components. The fitting can be released by rotating either the end cap 13 or the accessory cap 80 until the tongue sections 132 of the end cap 13 return to the location of the grooves 84. In some embodiments, the accessory cap 80 has one or more slots 85 at the base section 81 and/or inside the female fitting section 82 which facilitate manufacturing and allow the components to flex somewhat to accommodate repeated insertion and removal of the end cap 13.

Figure 9:
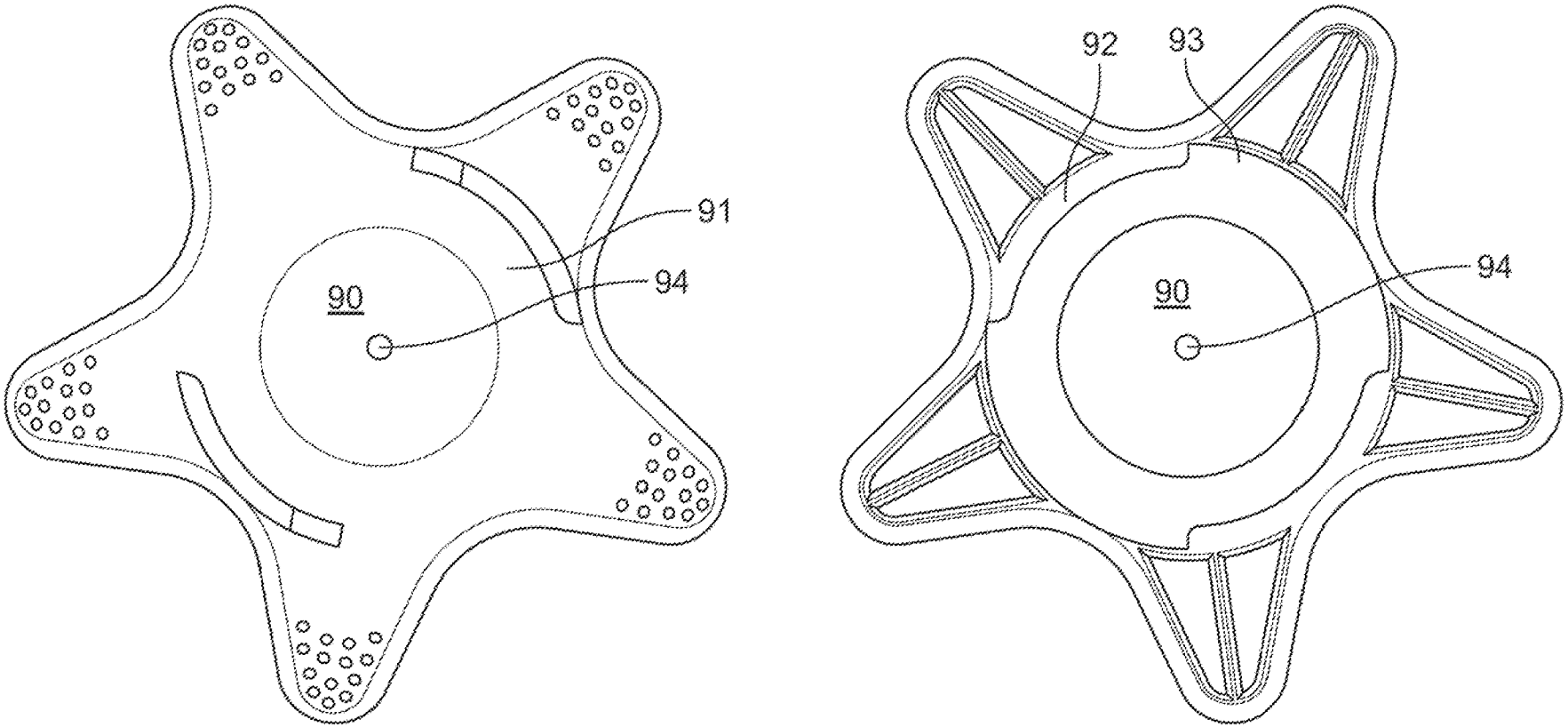
FIG. 9 shows another accessory cap, with a star shape, configured as a female fitting.

FIG. 9 shows an embodiment of an accessory cap 90 configured as a standalone cap to be used for toys and freestanding accessory items, such as the accessory cap 21 shown for use with accessory 20 in FIG. 1. Here, the accessory cap 90 comprises a star-shaped main body 91 wherein the perimeter of the cup includes inwardly extending notches 92, which delimit grooves 93. This provides a female fitting to accept the fitting structure of the end cap 13 as described above. Also shown is an aperture 94 which is enabled to receive a string or other fastener of a toy or accessory (see FIG. 1).

It is noted that in the described exemplary embodiments, the end cap is a male fitting and the accessory cap is a female fitting. However, the invention contemplates that the opposite may be equally suitable, i.e. with the end cap comprising the female fitting and the accessory cap comprising the male fitting.

It is to be noticed that the term "comprising," used in the claims, should not be interpreted as being limitative to the means listed thereafter. Thus, the scope of the expression "a device comprising means A and B" should not be limited to devices consisting only of components A and B. It means that with respect to the present invention, the only relevant components of the device are A and B. Put differently, the terms "including", "comprising" and variations thereof mean "including but not limited to", unless expressly specified otherwise.

Similarly, it is to be noticed that the term "coupled", also used in the claims, should not be interpreted as being limitative to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

The enumerated listing of items does not imply that any or all of the items are mutually exclusive, unless expressly specified otherwise. The terms "a", "an" and "the" mean "one or more", unless expressly specified otherwise.

Elements of the invention that are in communication with each other need not be in continuous communication with each other, unless expressly specified otherwise. In addition, elements of the invention that are in communication with each other may communicate directly or indirectly through one or more other elements or other intermediaries.

One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that any alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. A modular mobile and accessory system, comprising:

a flexible rod comprising an elongated flexible member wrapped with a relatively softer material;

the flexible rod having a proximal end and a distal end, wherein at least one of the proximal end and distal end includes an end cap;

wherein the end cap is configured to releasably engage an accessory cap of an accessory, the end cap and accessory cap having corresponding male and female fittings; and wherein the fittings comprise a rotating tongue-and-groove fitting, wherein the end cap of the rod comprises the male fitting and the accessory cap comprises the female fitting.

2. The modular mobile and accessory system of claim 1, including a wire cap seated in the end cap, the wire cap receiving and retaining the elongated flexible member.

3. The modular mobile and accessory system of claim 1, wherein a silicone or rubber sleeve is disposed over and around the end cap.

4. The module mobile and accessory system of claim 1, wherein the end cap includes:

a tapered body section with a narrowed male fitting section extending therefrom; and one or more tongue sections extending radially outward from the male fitting section.

5. The module mobile and accessory system of claim 4, wherein the accessory cap includes:

a base section with a narrowed female fitting section extending outwardly therefrom;

a perimeter of the edge of the female fitting section includes inwardly extending notches which delimit grooves; and wherein the tongue sections of the end cap are received into the grooves such that the end cap is seated inside the accessory cap.

6. The module mobile and accessory system of claim 5, wherein rotating either the end cap or the accessory cap causes the tongue sections to rotate to a position disposed at least partially behind the notches.

7. A modular mobile and accessory system, comprising:

a flexible rod comprising an elongated flexible member wrapped with a relatively softer material;

the flexible rod having a proximal end and a distal end;

wherein each of the proximal and distal ends of the rod include an end cap, the end cap of the proximal end configured to releasably engage an accessory cap of a first accessory and the end cap of the distal end configured to releasably engage an accessory cap of a second accessory, the end caps and the accessory caps each having corresponding male and female fittings; and wherein the first accessory comprises a headband or a claw and the second accessory comprises a dangling toy.

8. A modular mobile and accessory system, comprising:

a flexible rod comprising an elongated flexible member wrapped with a relatively softer material;

the flexible rod having a proximal end and a distal end;

wherein each of the proximal and distal ends of the rod include an end cap, the end cap of the proximal end configured to releasably engage a first accessory cap of an accessory and the end cap of the distal end configured to releasably engage a second accessory cap of the accessory, the end caps and the accessory caps each having corresponding male and female fittings.

* * * * *